United States Patent [19]

Greenewald, Jr.

[11] 3,975,578

[45] Aug. 17, 1976

[54] INDIRECT ARC METAL MELTING FURNACE METHOD

[76] Inventor: Herbert Greenewald, Jr., 4296 Braunton Road, Columbus, Ohio 43220

[22] Filed: June 3, 1975

[21] Appl. No.: 583,249

Related U.S. Application Data

[60] Continuation-in-part of Ser. No. 479,105, June 13, 1974, abandoned, which is a division of Ser. No. 355,285, Apr. 27, 1973, Pat. No. 3,821,455.

[52] U.S. Cl. ..... 13/34

[51] Int. Cl.[2] ..... H05B 7/22

[58] Field of Search ..... 13/1, 9, 9 P, 10, 34, 13/31

[56] References Cited

UNITED STATES PATENTS

| | | | |
|---|---|---|---|
| 3,057,937 | 10/1962 | Shaw | 13/10 |
| 3,106,594 | 10/1963 | Beasley et al. | 13/9 X |
| 3,520,977 | 7/1970 | Petersen et al. | 13/9 P |
| 3,711,615 | 1/1973 | Petersen et al. | 13/1 |

*Primary Examiner*—R. N. Envall, Jr.
*Attorney, Agent, or Firm*—Daniel H. Dunbar

[57] ABSTRACT

An indirect arc metal melting furnace of the type having an insulated and essentially sealed or closed exterior shell is operated in a novel manner which thereby improves the electrical operating characteristics of the furnace.

5 Claims, 4 Drawing Figures

INDIRECT ARC METAL MELTING FURNACE METHOD

CROSS-REFERENCES

This is a continuation in-part of application Ser. No. 479,105, filed June 13, 1974, now abandoned which application was a division of application Ser. No. 355,285 granted June 28, 1974 as U.S. Pat. No. 3,821,455.

SUMMARY OF THE INVENTION

An indirect arc metal melting furnace having an insulated and essentially closed exterior shell contains an interior crucible that receives the furnace metal values charge. An ionizable gas such as elemental argon, vaporized alkali metal halide, vaporized alkaline earth metal halide, vaporized zinc, vaporized magnesium, vaporized aluminum, vaporized copper, vaporized silicon, vaporized chromium, vaporized iron, vaporized beryllium, vaporized manganese, nitrogen, carbon monoxide, metal oxide vapors, helium hydrocarbons, hydrogen, vapors resulting from the chemical reaction of carbon, coal, coke, hydrocarbons, hydrogen, or other solid or gaseous reductant with a metal oxide or element considered to be a metalloid (e.g., silicon), or combinations of any of the preceding is contained in the interior crucible along with the melting charge, and opposed electrodes are projected into the crucible interior and energized through water-cooled and sealed electrode holders by electrical energy flowed therethrough from a power source such as a constant voltage, variable current power supply in a manner that thereby obtains improved electrical energy conversion efficiency for the equipment arrangement.

DETAILED DESCRIPTION

Figure 1:
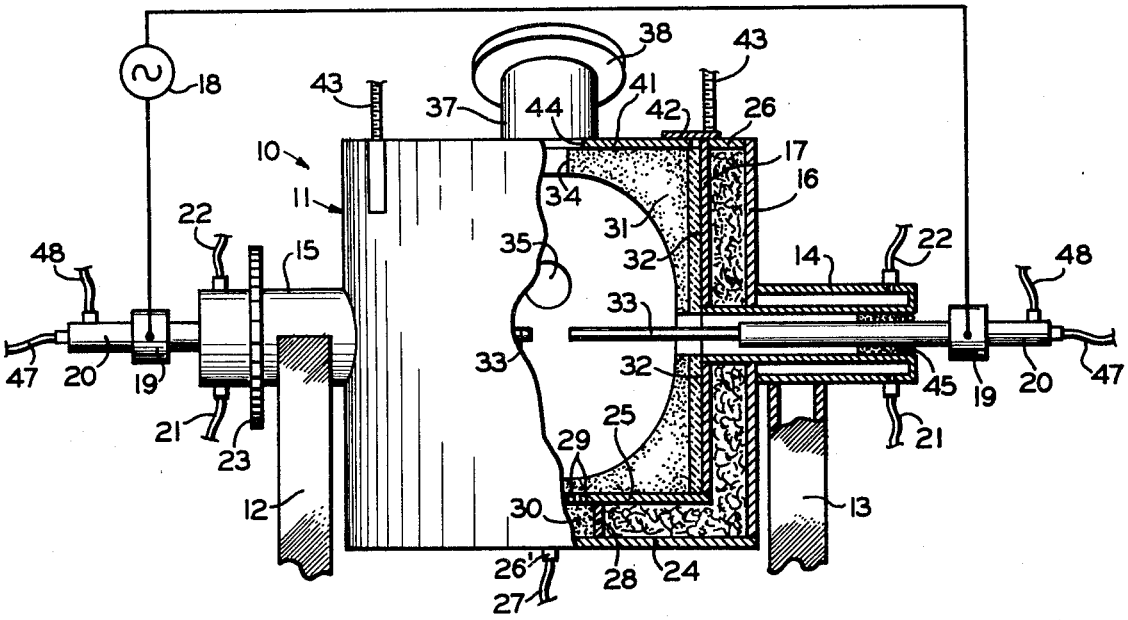
FIGS. 1 and 2 are elevational and plan views, respectively, of one form of indirect arc metal melting furnace which may be operated in accordance with the method of this invention.
Figure 2:
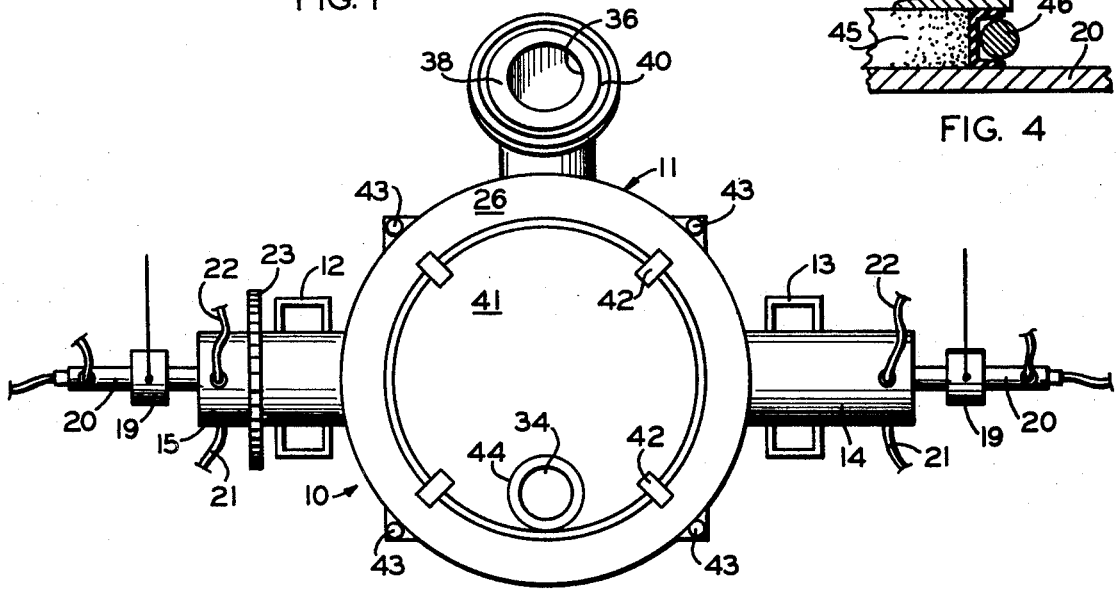

One embodiment of an indirect arc metal melting furnace that may be operated in accordance with the method of this invention is referenced generally as 10 in FIGS. 1 and 2 of the drawings. Basically, furnace 10 is comprised of a rotatable shell assembly 11, supports 12 and 13 that rotatably support assembly 11 through the water cooled trunnions 14 and 15 welded to the outer and inner shells 16 and 17, and an energy source such as constant voltage, variable alternating current electrical power supply (illustrated schematically as 18) electrically connected to the slip terminals 19 that cooperate with water cooled electrode holders 20. Trunnions 14 and 15 each include a horizontal baffle (not shown) generally along the axis of rotation to effect complete cooling by water flowed through the trunnion interior from bottom inlet hose 21 to upper outlet hose 22. This water cooling is needed primarily to remove heat developed in the trunnion metal by eddy current, induced current flow, and hystereris losses occasioned by the magnetic fields generated by the flow of current through the electrode holders. It is therefore necessary and possible to minimize power losses to cooling water or eliminate the need for cooling water by increasing the distance between the outside diameter of the electrode holder or electrode proper and the inside diameter of the metal trunnion wall. In practice it has been found that this spacing should be held to a minimum of about 2 inches if heating of the trunnion wall is to be held to reasonable levels. Trunnion 15 differs from trunnion 14 essentially only in that it is provided with a drive sprocket 23 for effecting shell assembly rotation. Any conventional powered drive may be used for turning assembly 11 through sprocket 23.

Outer and inner shells 16 and 17 are preferably made of mild steel, and are provided with circular bottom plates 24 and 25 with an annular top plate 26, also of mild steel, welded thereto. Bottom plate 24 in the illustrated furnace embodiment is provided with an inlet fitting 26' which cooperates with an atmosphere supply hose 27. Gas injection need not necessarily be through a porous plug and crucible bottom in that the gas may be introduced from the crucible top or other crucible zones or through the electrode holders if suitable provisions are made. Plate 25 is supported by annular pipe spacer 28 and is provided with drilled holes 29 in communication with the porous ceramic material 30 located interiorly of spacer 28 and with inlet fitting 26'. The components of shell assembly may be welded together but it is only required that the inner shell be reasonably gas tight. The outer shell may be attached by welding or by brackets bolted to the inner shell. The insulation between inner and outer shells may be rigid, fibrous, or of the radiation shield type. The only requirement is that the inner shell be insulated so that it readily attains in operation a temperature sufficient to completely outgas the refractory materials contained within the inner shell. If conventional refractories are used this may require the inner shell to be heated throughout to temperatures of about 1750°F. and in this case it is best that the inner and outer shells be welded together and the space between them filled with rigid and structurally supportive refractory materials. If newly developed refractory materials which completely outgas at temperatures of 800°F. and below are used this inner shell temperature may be limited to 800°F., and in this case the simple encasement of the inner shell with insulating blankets, radiation shields, or other such insulating means without the necessity of the outer shell providing structural support for the inner shell is adequate. Insulating material is packed into the zones intermediate shells 16 and 17 and intermediate plates 24 and 25 before the assembly is closed by the attachment of plates 24 and 26 into proper position. If the inner and outer shells are welded together, appropriate expansion joints must be provided in the inner shell.

The interior of shell assembly 11 is provided with a crucible lining 31, which may be constructed of premolded refractory crucible halves, brick, or cast or rammed refractory in monolithic form. In the furnace embodiment shown the lower crucible half rests on plate 25 and is surrounded by a backup refractory filler 32. Openings are provided in the crucible 31 halves in registry with the interior openings of trunnions 14 and 15 to facilitate insertion and withdrawal of electrodes 33. Electrodes 33 may be made of graphite material and of other materials such as tungsten.

As an alternate form, instead of two electrodes properly placed and equipped, the furnace may be provided with three electrodes suitably connected as to three-phase current or more than three electrodes.

The diameter of these electrodes is important to the successful operation of the furnace and is determined by the current flowing through them. The attachment of the electrodes to a watercooled electrode holder permits the electrodes to be heated to a red heat or above throughout most of its length by the electrical resistance of the electrode material to the passage of current while keeping the portion of the electrode in immediate contact with the holder relatively cool. For example, it is feasible to have an electrode with three clearly observable temperature zones in operation in the furnace. The zone of the electrode in immediate contact with the holder and for about 6 inches out from the holder is in the black heat range, the very tip of the electrode emitting electric current into the arc is white hot, and the intermediate zone is a bright red or yellow heat depending on the furnace temperature. It is important to the operation of the furnace that the relationship of the electrode diameter to the current (not power but just amperes of current) flowing through the electrodes be such that the whole tip of the electrode may be kept at about a white heat and that stable emission of electricity into the arc zone without erratic movement of an "arc spot" be maintained. For example, for a current flow of 2000 amperes a 2 inch diameter graphite electrode or a current density of approximately 630 amperes per square inch of electrode cross-sectional area is suitable. In a conventional indirect arc furnace an electrode diameter of 5 to 6 inches would be used for this current flow thereby having furnace operations carried out at electrode current densities of from approximately 70 to 100 amperes per square inch of electrode cross-sectional area. Obviously, the graphite electrode must be protected from oxidation throughout its hot zone if it is to remain in use for any appreciable length of time. On the other hand, if too small a diameter electrode is used it will be resistance heated to a temperature which will cause the refractory in the electrode hole and particularly at the intersection of the electrode hole with the interior of the crucible to melt. A closable discharge opening 34 is provided in the upper crucible half as well as an inlet opening 35 that cooperates with the longitudinal interior lining opening 36 (FIG. 2) in charging chute 37. By way of example, an inverted relatively impermeable ceramic casting mold or a metal ingot mold may be placed with its ingate over opening 34 and placed abutting to top plate 42 to serve also as a closure member. Alternatively a closure flange or plate may be provided. A flange 38 is preferably welded in sealed relation to the free end of chute 37 and is provided with a groove 40 for receiving a conventional O-ring seal. During operation of furnace apparatus 10 a heavy clear acrylic plate may be clamped to the face of flange 38 to provide a sealed viewing port. In other embodiments of furnace apparatus operated in accordance with the present invention it may be preferred to utilize a conventional valved charging lock at the free end of chute 37 rather than a viewing port type of opening to the crucible interior. It may also be preferred to provide both a charging and a viewing port. The crucible 31 is held in position in shell assembly 11 by a circular mild steel top plate 41 secured to annular top plate 26 by temporary welded clips 42 or by bolted attachments. Threaded rods 43 welded to outer shell 16 are provided for use in conventionally clamping an inverted mold on top of assembly 11 with its feed gate aligned with opening 44 in plate 41 and with opening 34 in crucible 31.

Figure 4:
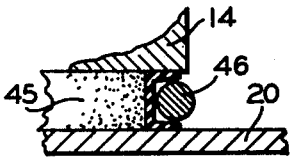
FIG. 4 is a sectional view detailing a form of seal employed in the furnace construction illustrated in FIGS. 1 and 2.
Figure 3:
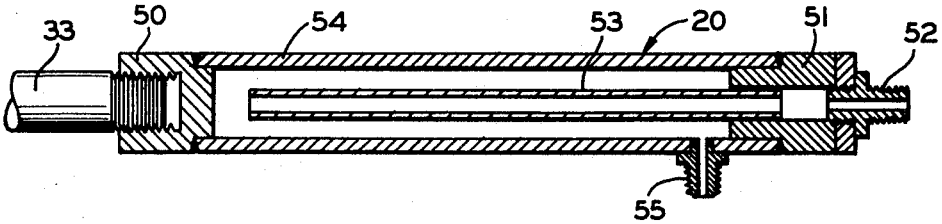
FIG. 3 is a sectional view of an electrode holder construction preferred for the furnace illustrated in FIGS. 1 and 2.

Each electrode holder 20 preferably cooperates with a ceramic sleeve 45 positioned interiorly of a water cooled trunnion and additionally cooperates with a conventional elastomer (e.g., molythane) cup and O-ring seal 46 which provides both sealing against the passage of gas and electrical insulation between the electrode holder and the trunnion outermost end. See FIG. 4. A preferred construction for each electrode holder 20 in order that it might be adequately cooled by water flowed to and from the inlet and outlet water hoses 47 and 48 is illustrated in detail in FIG. 3. As shown in that illustration, electrode holder 20 is essentially made up of threaded copper end fitting 50 engaged with graphite electrode 33, end fitting 51 having inlet hose fitting 52 and inlet tube 53 securedly attached thereto, and heavy walled exterior tube 54 welded to end fittings as shown. An outlet hose fitting 55 cooperates with tube 54 near end fitting 51 and normally is located in a top position for cooperation with outlet hose 48 (FIG. 1). From the drawing it will be noted that cooling water is ported through fitting 52 and tube 53 to first play against end fitting 50 and then counterflows through the zone between tubes 53 and 54 for discharge through fitting 55 thus effecting electrode holder and electrode attach end cooling in a very efficient manner. The indirect arc metal melting furnace embodiment illustrated in the drawings is rotatable and utilizes a single pair of opposed electrodes. It will be readily appreciated that alternate embodiments might be provided utilizing the same basic principles of shell and crucible construction but having multiple pairs of opposed electrodes or having a rotational axis positioned near the furnace shell metal discharge opening. Although FIGS. 1 and 2 apparatus embodiment is normally constructed so that the axes of electrode holders 20 are coincident and pass through the apparatus center of gravity, such is not necessary or even desirable in all metal melting furnace constructions.

The key steps of features of the method of operating an indirect arc furnace of this invention are:

1. Provision of a furnace shell interior from which all water, combined chemically or otherwise, is eliminated. This is necessary if a truly controlled atmosphere composition is to be maintained within the furnace.

2. Provision of a gaseous atmosphere within the furnace interior crucible which under operating conditions is substantially ionized. This atmosphere may consist of elemental argon, alkali metal halide vapors, alkaline earth metal halide vapors, zinc vapors, magnesium vapors, aluminum vapors, copper vapors, silicon vapors, chromium vapors, iron vapors, beryllium vapors, manganese vapors, nitrogen, carbon monoxide, metal oxide vapors, hydrocarbons, hydrogen, helium, vapors resulting from the chemical reaction of carbon, coal, coke, hydrocarbons, hydrogen, or other solid or gaseous reductant with a metal oxide or element considered to be a metaloid (e.g., silicon), or combinations of any of the preceding. Two halides found satisfactory in particular applications for this purpose are potassium chloride and calcium fluoride.

3. Provision of at least one pair of graphite or tungsten electrodes projected into the furnace melting chamber and contained ionizable atmosphere and connected to an exterior source of alternating current electric power, through attached and water cooled electrode terminals or holders, that flows electrical energy through such electrodes at electrical current densities substantially above 100 amperes per square inch of electrode cross-sectional area and preferably to at least approximately 600 amperes per square inch as above mentioned since it is desired that most of their length be heated to a red heat or above by their resistance to the flow of electric current and that the arcing tip of the electrode be heated to an approximate white heat during arc operation.

The major differences in furnace operating characteristics achieved in this invention as compared to other indirect arc furnace operations are:

1. The achieved power factor in the electrical operation of the furnace without the need for power factor correction devices external to the electrode terminals is approximately 1 as compared with power factors of from 1/3 to 1/2 in conventional indirect arc furnaces operated without the ionized interior atmosphere.

2. Arc lengths for any given voltage are greatly increased. For example, in a normal indirect arc furnace at an arc voltage of AC 44 volts the arc gap would be about 1/16 inch and in this invention would be about ½ inch. At 200 volts the respective arc gaps would be about ¼ inch and 10 inches. Stabilized arc operating gaps in excess of 20 inches have in fact been attained in the practice of this invention to melt copper to a temperature of 2100°F. with an argon atmosphere ionized with 180 volts potential across the electrode terminals.

3. Because of the much longer arcs achieved in this invention a more uniform distribution of heat throughout the furnace is achieved. In particular the shadow effect of the electrode ends which is quite significant in the Detroit Rocking Arc Furnace becomes totally insignificant in the furnace used according to this invention.

4. The flow of electricity through the arc at constant voltage can be easily controlled by varying the arc length by varying the electrode spacing or gap. Since the feasible arc lengths are quite long this adjustment is possible to achieve over a wide range of current flows. Specifically, power input can be adjusted over a ratio of about 10:1 with a constant voltage power supply simply by varying the length of the arc gap. This is totally impossible with conventional arcs because the feasible range of arc lengths for a given applied voltage is too short to give any significant current flow adjustment by means of arc gap change. The usual method for varying power input to an arc furnace is by changing the applied voltage through tap transformers and other such expensive mechanisms.

Although FIGS. 1 and 2 of the drawings illustrate an indirect arc furnace advantageously incorporating a double shell construction, the method of this invention may also be practiced using other types of shell construction. For instance, in applications where furnace exterior surface temperatures equaling or somewhat exceeding approximately 500° F. are acceptable, inner shell 17 may be omitted provided the outermost refractory layer within the shell interior is out-gassed completely at temperatures equal to or below the acceptable exterior wall temperature. Refractory compositions having the desired out-gassing property at relatively low temperatures are known. For instance, see certain examples detailed in my co-pending patent application Ser. No. 370,624 filed June 18, 1973. Also, the material forming the ionizable atmosphere within the crucible need not be introduced to the interior through the crucible bottom. Solid ionization agents may be introduced into the furnace interior with the metal values charge or may be introduced separately. Gaseous ionization agents may be introduced through a passageway provided in the electrode and electrode holder combination. In some cases the ionized atmosphere is formed in the furnace during furnace operation as when metal vapors are derived from molten metal during melting or as when carbon monoxide if formed during reduction smelting of metal oxides.

The method of furnace operation of this invention, as a result of the ability to control the composition of the internal atmosphere, is usable to effectively melt steels, coppers, nickel-base superalloys, and other metals and to smelt ferroalloys, silicon and other carbides, and the like while obtaining technical results identical to those obtainable in vacuum induction melting without the need to resort to the use of expensive vacuum equipment.

Another unexpected and unusual effect of the use of this invention is the very substantial reduction in the amount of graphite consumed through electrode wear. It is generally recognized that in conventional arc furnaces the rate of electrode consumption is many times that which can be accounted for by oxidation of the graphite in the hot zone. In many such furnaces the cost of graphite electrodes consumed is a major fraction of the cost of electric energy conversion in operating the furnace. In the method of this invention not only is the loss of graphite from oxidation eliminated by control of the furnace atmosphere, but unexpectedly the total consumption of graphite is reduced to negligible proportions. For example, for a power input of 200 kilowatts the graphite consumption is reduced from a rate of about 4 inches per hour of electrode in a conventional furnace to about ¼ inch per hour by the practice of this invention. Under some operating conditions the rate of graphite consumption in the practice of this invention is as little as ⅛ inch per hour at 200 kilowatts power input.

Some electrically conductive refractories such as graphite have high strengths and great resistance to thermal shock at elevated temperaturess and accordingly may advantageously be incorporated into furnace apparatus interiors continously utilizing a non-oxidizing atmosphere. Specifically, in instances in which metals not reacting with or dissolving carbon significantly, such as copper or aluminum, are to be melted in furnace 10, a crucible can be constructed substantially entirely of graphite or with a graphite interior roof and/or graphite interior floor set into non-conductive crucible refractory lining. Arc stability can be maintained continuously provided the requisite degree of ionization is maintained in the crucible interior atmosphere. Also, it should be noted that the construction of furnace shell assembly 11 is such that the various mild steel top and bottom plates 24 through 26 and 41 and inner and outer shells 16 and 17 do not serve to induce adverse magnetic fields during furnace operation when properly placed in the normal illustrated positions.

In order that the metal melting method of this invention achieve the desired results, it is also necessary that the provided ionizable gaseous atmosphere be maintained in the crucible interior during the operation of power supply 18 to conduct electrical energy current between electrodes 13. Failure to maintain such atmosphere will normally result in rapid electrode consumption, in a low power factor causing a low power input and generally inefficient furnace operation, and in highly undesireable electric arc instability. Undesireable moisture impurity additions to the atmosphere provided to the furnace interior may be sourced in the leakage of atmospheric air into the furnace crucible interior or in the outgassing of moisture (or even other chemical impurities) from the crucible refractory lining. Such outgassed moisture may be sourced either as occluded moisture at the crucible interior surface or as water of crystallization chemically combined into the crucible composition being utilized and released by exposure to the high temperatures required in the furnace interior to melt metal.

The problem of minimizing air leakage into the furnace crucible interior is also conveniently controlled by known exterior shell and electrode sealing techniques such as are shown in the drawings. Moisture outgassing, on the other hand, apparently is satisfactorily controlled in either one or both of two manners.

First, and not a part of this invention, moisture outgassing may be controlled in part by the selection of crucible lining compositions which do not contain combined water of crystllization. Cured castable (not containing hydraulic cements) or rammable refractory comprised of essentially pure alumina, for instance, meets this objective and is known to be at least under development if not already available. Compositions disclosed in U.S. Pat. No. 3,164,872 are also suitable. Absent a composition that is free of combined moisture or water of crystallization, a conventional castable or rammable refractory composition must be used in a crucible and must typically be fired to a temperature of 1500°F. to 2000°F. throughout to effect complete moisture separation and removal from the crucible interior. Occluded water, on the other hand, may be completely removed from the crucible upon heating the interior of shell 17 throughout to temperatures substantially above the associated boiling point temperature. Such water normally comprises a very small fractional part of the contained water in a complete furnace system haveing crucibles of conventional refractory composition.

The other manner of controlling moisture outgassing in a metal melting furnace system involves utilization of the furnace construction shown in the drawings. Basically, apparatus 10 is constructed so that the inner shell 27 is located at about a 1400°F. position on the furnace thermal gradient existing between the interior of the crucible 31 and the exterior surface of shell 16 during normal continuous operation. By utilizing the disclosed double shell construction for assembly 11, the refractory lining 32 as well as the crucible component 31 more quickly completely reach a temperature during furnace steady operation whereat the contained water is entirely driven off and the electrical arc becomes stabilized. By way of example, a conventionally constructed melting furnace with single furnace shell and having a 200 pound metal melt capacity, requires approximately three weeks of continuous heating under vacuum to completely remove contained water from a conventional refractory lining and arrive at a stabilized arc operating condition. The same furnace operating under identical conditions except that a refractory liner material containing no water of crystallization was employed, required approximately four hours operation under vacuum conditions to completely eliminate all contained moisture and stabilize are operation. By the further use of a double shell construction as shown in the drawings to achieve a minimum refractory lining thickness, the time required to completelu outgas the water of crystallization from the refractory without the need for vacuum conditions was reduced by approximately 50% to 2 hours for complete water removal. An improved operating power factor is more rapidly realized and concomitant reduction in rate of electrode comsumption from approximately 4 inches per hour to ¼ inch per hour was also achieved sooner by improving arc stability. A requirement for continuous adjustment of electrode position for nonintermittent electrode operation was quickly reduced to adjustment-free electrode operation for periods of from 15 minutes to 30 minutes. Also, since the regions intermediate furnace shells 16 and 17 are sealed, scaling of the metal walls by oxidation attack is minimized and furnace life significantly prolonged.

Two comments are in order with respect to the electrical characteristics of apparatus 10 when an alternating current electrical supply is employed for furnace operation. First, an apparent power factor of 1 (100%) is developed with a proper atmosphere and no adverse induced magnetic fields. Second, the atmosphere breakdown voltage on each half cycle under the same operating conditions is low compared to the peak voltage and is relatively constant. Higher operating voltages therefore effect greater electrical efficiencies.

Having thus described my invention, what I claim as new and desire to secure by Letters Patent is:

1. In a method of operating an indirect arc furnace of the type having separated electrodes projected from electrode terminals into a crucible interior during melting of a contained metal charge, the combined steps of:

a. providing a water-free, oxygen-free, ionizable atmosphere within said crucible interior in a zone separating said interiorly projected electrodes;

b. flowing alternating current electrical energy through said electrodes and as between said electrode terminals at a constant voltage, at high electrical current densities, and at a power factor of approximately one apparent to said electrode terminals; and c. establishing a preferred level of electrical power input to said furnace during melting of said contained metal charge by controlling the separation between said interiorly projected electrodes.

2. The method of operating an indirect arc furnace defined by claim 1 wherein said alternating current electrical energy is flowed through said electrodes and as between said electrode terminals at a current density substantially greater than 100 amperes per square inch of electrode cross-sectional area.

3. The method of operating an indirect arc furnace defined by claim 1 wherein said alternating current electrical energy is flowed at a current density of at least approximately 600 amperes per square inch of electrode cross-sectional area.

4. The method of operating an indirect arc furnace defined by claim 1 wherein the level of electrical power input to said furnace is changed from said preferred level to another level which differs in magnitude from said preferred level, and including an additional step of adjusting the separation between said interiorly projected electrodes without changing the constant voltage at said electrode terminals until said another level of electrical power input is attained.

5. The method of operating an indirect arc furnace defined by claim 1 wherein said ionizable atmosphere within said crucible interior consists of gases from the group comprised of elemental argon, alkali metal halide vapors, alkaline earth metal halide vapors, zinc vapors, magnesium vapors, aluminum vapors, copper vapors, silicon vapors, chromium vapors, iron vapors, beryllium vapors, manganese vapors, nitrogen, carbon monoxide, metal oxide vapors, helium, hydrogen, hydrocarbons, and vapors resulting from the chemical reaction of a reductant with a metal oxide at elevated temperatures.

* * * * *